US006491410B2

(12) United States Patent
Ladstätter et al.

(10) Patent No.: US 6,491,410 B2
(45) Date of Patent: Dec. 10, 2002

(54) LIGHTING STRIP SYSTEM AND A METHOD OF MOUNTING A LIGHTING STRIP SYSTEM

(75) Inventors: Gerald Ladstätter, Klaus; Wolfgang Gadner, Hörbranz, both of (AT)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 09/896,617

(22) Filed: Jul. 2, 2001

(65) Prior Publication Data

US 2002/0003702 A1 Jan. 10, 2002

Related U.S. Application Data

(63) Continuation of application No. PCT/EP99/10397, filed on Dec. 27, 1999.

(30) Foreign Application Priority Data

Dec. 30, 1998 (DE) ..... 298 23 256 U
Dec. 30, 1998 (DE) ..... 298 23 255 U

(51) Int. Cl.[7] ..... F21V 23/02

(52) U.S. Cl. ..... 362/221; 362/147; 362/219; 362/225; 439/121; 439/211

(58) Field of Search ..... 362/147, 148, 362/404, 406, 217, 221, 260, 250, 225, 219, 224; 439/571, 94, 116, 121, 211, 235, 532, 533

(56) References Cited

U.S. PATENT DOCUMENTS 4,976,633 A 12/1990 Beghelli ..... 439/571
4,977,490 A * 12/1990 Davies ..... 362/221
5,357,412 A * 10/1994 Entrop et al. ..... 362/217

FOREIGN PATENT DOCUMENTS

| | | |
|---|---|---|
| DE | 39 20 614 A1 | 12/1989 |
| DE | 25 45 038 A | 4/1997 |
| DE | 196 15 597 A | 10/1997 |
| EP | 0 624 754 A | 11/1994 |

* cited by examiner

*Primary Examiner*—Sandra O'Shea
*Assistant Examiner*—John Anthony Ward
(74) *Attorney, Agent, or Firm*—Fitzpatrick, Cella, Harper & Scinto

(57) ABSTRACT

A lighting strip system, including a carrier rail (3), which bounds a hollow space, to be mounted on a wall or ceiling, a plurality of electrical wires (12) running longitudinally in the hollow space, for the delivery of supply voltage and, if applicable, control signals. The lighting strip system also includes a plurality of coupling parts (13*a*) arranged in the hollow space with spacing in the longitudinal direction of the carrier rail (3). The coupling parts are electrically connected with the wires (12). A plurality of elongate lights (A1, A2, A3 . . . ) can be mounted one after another on the carrier rail in longitudinal direction. Electrical counter-coupling parts (13*b*) are provided on the lights (A1, A2, A3 . . . ) which when placed on the carrier rail (3) enter into the hollow space and make electrical plug contact with corresponding coupling parts (13*a*). In order to attain a simple and in particular rapid mounting, the coupling parts (13*a*) and the wires (12) constitute a prefabricated intermediate product, the carrier rail (3) being so formed that the intermediate product can be moved longitudinally into the carrier rail (3).

23 Claims, 4 Drawing Sheets

LIGHTING STRIP SYSTEM AND A METHOD OF MOUNTING A LIGHTING STRIP SYSTEM

REFERENCE TO RELATED APPLICATIONS

This is a Continuation of copending International Application No. PCT/EP99/10397, filed Dec. 27, 1999 and published in German, but not in English, on Jul. 13, 2000, the priority of which is claimed.

BACKGROUND OF THE INVENTION

1. Field of the Invention

This invention relates to a lighting strip system which comprises a carrier rail with a hollow space, a plurality of electrical wires running longitudinally through the hollow space, a plurality of coupling parts spaced apart from each other longitudinally within the hollow space and electrically connected with the wires, a plurality of lights which are mountable one after another along the carrier rail, the carrier rail having a wall formed with recesses and electrical counter-coupling parts provided on the lights and extending through the recesses when the lights are mounted whereby the counter-coupling parts make electrical plug contact with corresponding coupling parts within the hollow space.

2. Description of the Related Art

An example of a lighting strip system to which this invention may be applied is described in EP 0 624 754 A1. However, that document fails to disclose how the wiring and coupling parts are mounted.

In particular, large rooms such as e.g. auditoria, halls or long corridors, it is usual, for the illumination of the room concerned, to install so-called track lights or lighting strips, which may consist of a plurality of lights or lighting bars arranged one after another in each case in a row, which can be mounted on the carrier concerned, e.g. a ceiling or wall of the room, directly or by means of a carrier rail.

In DE 196 15 597 A1 there is described a device of the kind indicated in the introduction for contacting the conductor wires of a through-wiring with the conductor wires of electrical connection conductors of the lights of a track light. This previously known lighting strip has a longitudinal channel, in particular rectangular, consisting of a carrier rail and a cover rail, through which the wires of the through-wiring extend. The carrier rail and the cover rail are releaseably connected with one another by means of a quick-fastening connection. In the carrier rail there is arranged a plug-in sleeve connected by suitable means, e.g. a quick-fastening connection, with the base wall of the carrier rail. The plug-in sleeve consists of a base part which receives the wires in slots and a cover part arranged towards the cover rail which has plug-in sleeve holes in which there are arranged contact elements connected with the wires. The plug-in sleeve forms a first plug-in connection part associated with the carrier rail, which can be contacted with a second plug-in connection part having contact elements which is attached to the cover rail and the contact elements of which are connected with the lamp wiring. With this known configuration, the lamp is held in plug-in sockets, as is per se known, which stand up outwardly from the cover rail. With this known lighting strip it is possible to install the wiring from the open side of the carrier rail.

In DE 39 20 614 A1 there is described an attachment and connection system for the rapid mounting of lamps, in particular of lamps having a watertight housing. The main parts of this known attachment system are a holder, which can be attached to a ceiling or a cable guide by means of screws, whereby a two-part lamp housing is connected with the holder by means of a connecting device provided with hooks. Between the holder and the housing tub lying opposite thereto a through passage for cables is provided, which cables are longer than the holder and are mounted on a (non-illustrated) cable connection, which is arranged on the housing, for the electrical supply of the lights.

According to DE-A-2 545 038 there is described an arrangement for the through-wiring of lighting strip lights, with which a prefabricated intermediate product is manufactured from the wires and the coupling parts. This intermediate product is mounted above the lamp housings arranged in series, where normally no spatial restriction exist for this intermediate product.

SUMMARY OF THE INVENTION

The object of the invention is to further develop a lighting strip system of the kind indicated above that a simple and in particular rapidly effectable mounting of the wires or the through-wiring is ensured, and the mounting of the associated coupling part in the spatially restricted hollow space of the carrier rail is ensured.

This object is achieved by means providing coupling parts that are slidable within the carrier rail so that the coupling parts or slides which contain the coupling parts and the wires form a prefabricated intermediate product. The cross-sectional dimensions of the coupling parts or slides are adapted to associated internal dimensions of the carrier rail that the coupling parts or slides are longitudinally displaceable in the carrier rail with a slight plug for movement, whereby the carrier rail internally forms a longitudinal guide for the coupling parts or the slides. Advantageous further developing features of the invention are also described and claimed herein.

The mounting of the wires with the at least one coupling part arranged prefabricated thereon is effected in that the wires are moved longitudinally into the hollow space of the carrier rail. This can be effected by means of pulling or pushing the wiring units. The latter is possible due to the stiffness of the wires. Thereby, the wires may have a particular length adapted to the length of a lighting strip section, or they may be drawn off from a longer supply reserve, e.g. rolled off a roll. The longitudinal spacing of the coupling parts connected with the wires is determined by means of the longitudinal spacing of the recesses in the cover wall of the carrier rail or by means of the length of the associated lights of the lighting strip. Preferably, the coupling parts are in each case formed as slides or arranged in a slide which is displaceable longitudinally through the carrier rail into a longitudinal position in which the coupling parts coincide with the associated recesses or associated counter-coupling parts of the lights. Thereby, the position of these plug-in connection parts in the transverse direction can be determined by means of a guide. In the longitudinal direction the position can be determined by means of a particular length of movement which, due to the knowledge of the position of the at least one recess, is predetermined. It is also possible to limit this length of movement by means of stop which, e.g. through the recess, can be inserted into the carrier rail and by means of abutting limits the movements of one or each coupling part. After the introduction of the so-called wiring the lights of the lighting strip can be mounted by lateral placement on the carrier rail, whereby plugs arranged on the lights are connected as counter-coupling parts with the coupling parts by means of plugging together. The coupling parts and the counter-coupling parts are preferably plug-coupling parts. In this connection position, the through-wiring with the coupling parts is arrested by means of the counter-coupling parts.

Further, the wiring can be realized in a simple manner and with slight effort due to the axial introduction into the hollow space of the carrier rail, since the wiring needs only be pulled or pushed. With the known mounting measures, in contrast, the wiring must be mounted into the carrier rail by means of a lateral introduction movement, which in particular in the case of greater lengths of a lighting strip system is difficult and complicated.

BRIEF DESCRIPTION OF THE DRAWINGS

Below, the invention and further advantages which can be achieved thereby will be described in more detail with reference to simplified drawings and advantageous configurations.

DETAILED DESCRIPTION OF THE PREFERRED EMBODIMENT

Figure 1:
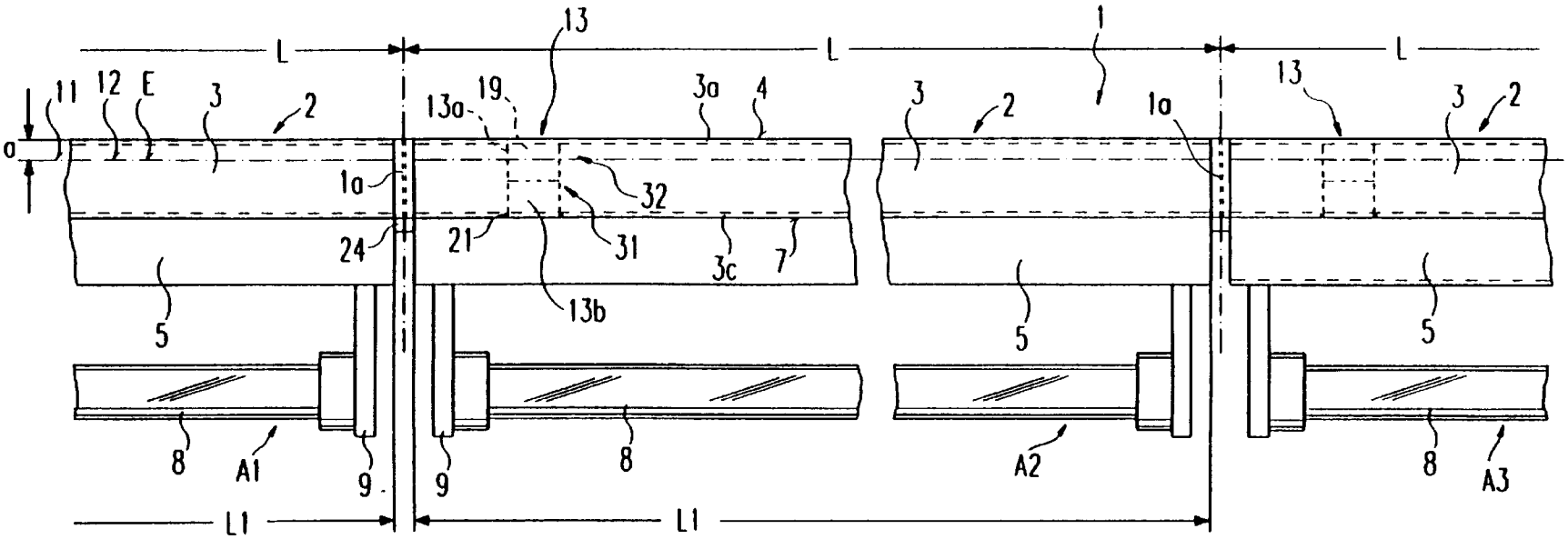
FIG. 1 is a side view showing a plurality of lighting strip sections in accordance with invention, of a lighting strip system.

Of the lighting strip designated by 1 in FIG. 1 there is illustrated only a longitudinal section of the associated lighting strip system, which consists of a plurality of lighting strip sections 2 or modules arranged in a row one after another. The lengths L of these sections or modules are preferably the same but in principle may differ, for example being determined by a transportable length of e.g. about 4 m to 6 m.

Schematically illustrated joints between adjacent lighting strip sections 2 are designated by reference characters 1*a*. Since the lighting strip sections 2 are identically formed, only one lighting strip section 2 will be described herein.

Figure 2:
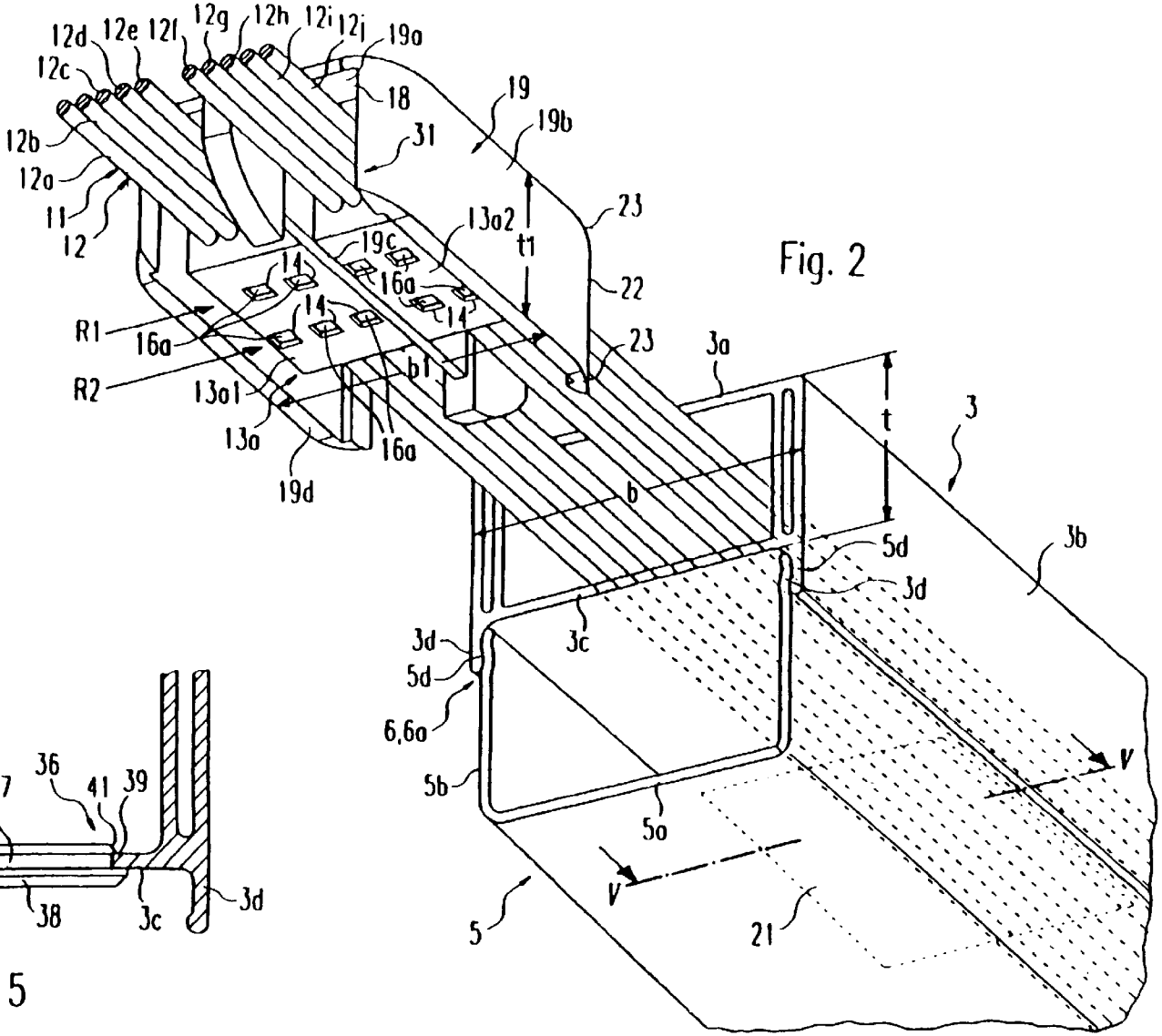
FIG. 2 is an exploded perspective view showing a lighting strip section and a first plug-in connection part in accordance with a first exemplary embodiment.
Figure 3:
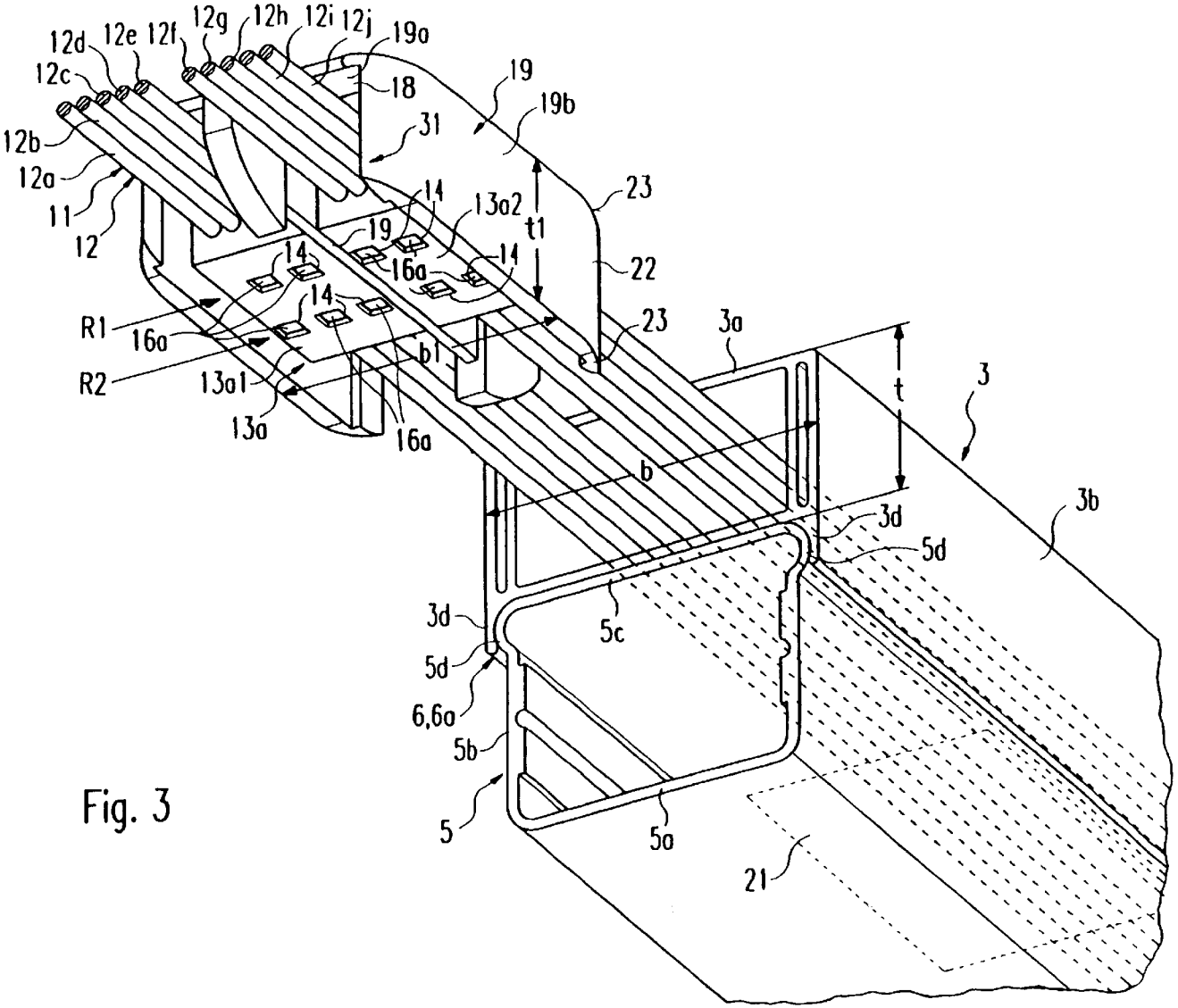
FIG. 3 is a view similar to FIG. 2 but showing a lighting strip section in accordance with a second exemplary embodiment.
Figure 4:
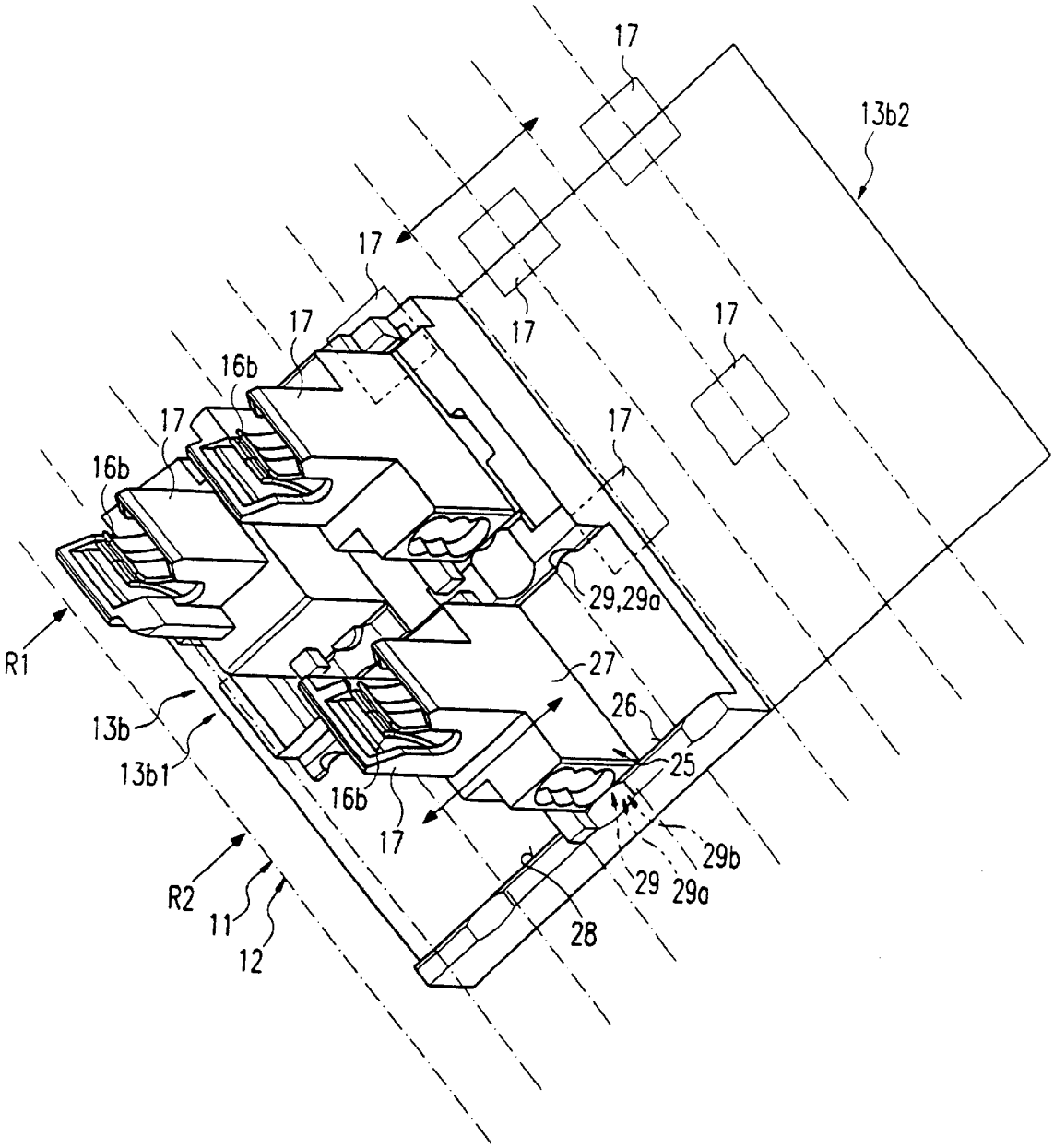
FIG. 4 is a perspective view showing a second plug-in connection part in accordance with the invention.

The main parts of the lighting strip section 2 are a carrier rail of tube-like or U-shaped cross-section. The carrier rail has a base side 4, shown in FIG. 1 at the top thereof, with which the carrier rail 3 can be attached to a carrier (not shown), e.g. a room ceiling or a room wall, by means of non-illustrated first fastening means, e.g. screws. A plurality of substantially similar lights A1, A2, A3, etc. are arranged one after another in the longitudinal direction of the lighting strip 1, in each case together with a tube-shaped light body 5. The tube-shaped bodies are each releasably connectable with a connection side 7 of the carrier rail 3 which is located away from the base side 4. The releasable connection is made by means of non-illustrated second fastening means, e.g. a quick-fastening connection 6 or a latching device 6*a*, as shown in FIGS. 2 and 3. One or more lamps 8 are arranged in parallel with each other in, or with the present exemplary embodiment, on the light body 5. The lamps, which may be gas discharge tubes, are held by means of mountings on mounting bodies 9 on the light body 5 and by means of the length L1 of the light bodies 5 is determined. A through-wiring 11 having a plurality of wires 12, preferably nine or ten wires 12*a* to 12*j*, extends longitudinally through the carrier rail 3. These wires are arranged in a plane E extending parallel to a base wall 3*a* of the carrier rail and at a spacing a from the base wall 3*a*. The wiring may be formed by one so-called flat conductor ribbon, or two arranged next to one another, the individual wires of which are held together by means of a ribbon extending longitudinally of the planeE. A plurality of plug-in connections 13, each for a light A1, A2, A3, etc., are preferably arranged off center, as viewed transversely of the longitudinal direction of the lighting strip 1. Each plug-in connection has a plug-in connection part 13*a* preferably in the form of a socket. The plug-in connection part 13*a* is arranged and positioned in the carrier rail 3 at the end face thereof towards the light body 5. As shown in FIG. 2, the plug-in connection part 13*a* has plug openings 14 of the same number as that of the wires 12. Also, as schematically illustrated in FIG. 2, contact elements 16*a* are arranged within the openings 14 which are located in a chamber. A second plug-in connection part 13*b* (FIG. 1), corresponding to the first plug-in connection part 13*a*, which is preferably in the form of a plug, is arranged on the light body 5 in opposition to the plug-in connection part 13*a*. As shown in FIG. 4, the second plug-in connection part 13*b* has plug-in contact elements 16*b* each in opposition to the plug openings 14 of the first connection part 13*a*. The contact elements 16 are arranged in one or two rows R1, R2, which extend transverse to the wires 12. Each contact element 16 can be contacted with a respective associated contact element 16*a* in the plug-in connection part 13*a*.

As can also be seen in FIG. 4, in the present configuration, the plug contact elements 16*b* of the second plug-in connection part 13*b* are each located in a plug shaft 17. The cross-sectional shape and size of the shaft 17 corresponds to the cross-sectional shape and size of the plug openings 14 of the first plug-in connection part 13*a* so that it can be plugged therein with slight play for movement. This provides a guiding directed transversely to the longitudinal direction of the lighting strip 1.

The carrier rail 3 is a profile section, for example of plastics or aluminum, which can be manufactured by extrusion or, in the case of a U-shaped cross-section, can be manufactured by bending.

The number of light bodies 5 which are arranged one after another along the length of the lighting strip section 2 is determined by the length L1 of the light bodies 5. This in turn is determined by means of conventional standardized dimensions of the elongate lamps 8 (which may be gas discharge tubes). The mounting bodies 9 (FIG. 1) are arranged at the ends of the light bodies 5 whereby in each case they stand out from the respective light body 5 on the connection side thereof away from the carrier rail 3. The lamps 8 may each be covered by means of a protective sleeve, which is not shown for reasons of simplification.

With the present configuration the first plug-in connection parts 13*a* are in each case formed by means of two plug-in connection parts 13*a*1, 13*a*2 in the shape of plug-in sleeves. These sleeves, which form plug coupling parts, are arranged transversely next to one another in a chamber 18 of a slide 19 and are held by means of non-illustrated latching devices. With the present configuration, the slide 19 has, in cross-section, a U-shape having a slide floor wall 19*a* towards the base side 4 (FIG. 1) and slide side walls 19*b*, extending in longitudinal direction. One or both plug-in connection parts 13*a*1, 13*a*2 are arranged transversely adjacent one another between the slide side walls 19*b* and the connection parts may be separated from one another by a longitudinally extending middle wall 19*c* of the slide 19. In a comparable manner the second plug-in connection part 13*b* (FIG. 4) which is associated with the respective lights A1, A2, A3, etc. can be formed by means of two plug-in connection parts 13*b*1, 13*b*2 or plugs lying transversely adjacent one another.

The first plug-in connection parts 13*a*1, 13*a*2 (FIG. 2) having contact elements 16*a* and the associated second plug-in connection parts 13*b*1, 13*b*2 having counter-contact elements 16*b* in each case form plug-in coupling parts and plug-in counter-coupling parts for the direct or indirect electrical connection of the plug-in contact elements 16*a*, 16*b* (FIG. 4) with the associated wires 12*a* to 12*j* (FIG. 2). Within the scope of the invention, the plug-in contact elements 16*b* may cooperate with the associated contact elements 16*a* belonging to the plug-in connection part 13*a*, or 13*a*1, 13*a*2, or the plug-in contact elements 16*b* may stand in direct contact with the associated wires 12*a* to 12*j*, whereby there may be involved the usual clamping contact elements or cutting/clamping contact elements, whereby the latter can cut into and contact insulated electrical wires 12. The mountings of the lamps 8 are in each case connected by means of conventional electrical conductors with the associated plug-in connection parts 13*b*1, 13*b*2.

The carrier rail 3 may have a U-shape in cross-section, whereby its side walls 3*b* form the limbs of the U-shape and its cover wall 3*c* forms a web wall of the U-shape. Alternatively, the carrier rail 3 may have the shape of a preferably quadrilateral tube which is formed by means of the base wall 3*a*, the cover wall 3*c* and the side walls 3*b*. With the present configuration, the width b of the carrier rail 3 is greater than its depth t in a direction transverse to the plane E. In such case the side walls 3*b* form narrow sides and the cover wall 3*c* forms a broad side. In the cover wall 3*c* there is present, opposite to each first plug-in connection part 13*a*, a common plug recess 21 for the second plug-in connection part 13*b* or there is present a plurality of plug recesses (not shown) for the plug shafts 17. In both cases the second plug-in connection part 13*b* is contactable with the first plug-in connection part 13*a*, through the cover wall 3*c* and into the hollow space of the carrier rail 3.

The plug recess 21 (FIG. 2) or a plurality of above-described smaller plug recesses in the hole pattern of the plug shafts 17, (FIG. 4) can be formed for example by stamping the cover wall 3*c* at the particular locations concerned so that a plug-in connection part 13*b* is provided at each location. The arrangement position is indicated by means of the position of the plug-in connection part 13*b* on the light body 5.

The width b1 and the depth t1 of the slide 19 are so adapted to the associated internal dimensions of the carrier rail 3 that the slide 19 is longitudinally displaceable in the carrier rail 3 with slight play for movement, whereby the carrier rail 3 forms a guide for the slide 19. In order to facilitate jamming and the introduction of the slide 19 into the carrier rail 13 the end face edges of the slide 19 are interrupted by means of edge breaks 22, 23 or oblique surfaces or roundings.

The light body 5 may be box-like and U-shaped in cross-section, as is shown in FIG. 2, or tube-like as is shown in FIG. 3. In both cases the light body 5 has a base wall 5*a* and side walls 5*b* extending therefrom. In the case where the light body is of a tube-shape, the side walls 5*b* are connected with one another by means of a cover wall 5*c*, whereas in the case of a U-shape, the side walls 5*b* are free web walls.

The quick-fastening connection 6 between the light body 5 and the carrier rail 3 preferably comprises a latching device 6*a* the latching effect of which can be manually overcome so that the light body 5 can be pressed into the latching device 6*a*, with a certain mounting or dis-mounting force which is larger than a latching force, and for the purpose of release can be again taken out. The latching device 6*a* may be formed by means of latching webs 3*d* on the carrier rail 3 which project from the side walls 3*b*. These latching webs extend continuously in a longitudinal direction. In the latching position, the webs 3*d* engage behind latching edges 5*d* on the side walls 5*b*. These latching edges extend preferably continuously in the longitudinal direction of the side walls 5*d* and they are elastically bendable to the side by means of a pulling force. The introduction of the light body 5 into the latching device 6*a* can be simplified by means of oblique surfaces or roundings on the side walls 5*b* and/or on the latching webs 3*d*. With the configuration according to FIG. 2, with which the light body 5 is U-shaped, the latching webs 3*d* may also be elastically yielding upon pressing of the light body 5 to overcome the latching force.

The plug-in connection part 13*b* (FIG. 4) is preferably a component associated with the light body 5, which is mounted onto the light body so that the light body 5 with the plug-in connection part 13*b* is moveable against the carrier rail 3 and into the recess 21 (FIG. 7). In this manner the plug-in connection part 13*b* connects with and contacts the plug-in connection part 13*a* and the quick-fastening connection 6 serves to releasably secure the light body 5 to the carrier rail 3. The plug-in connection part 13*b* is arranged on the light body 5 preferably off-center in its longitudinal direction, for example in its end region.

Since with a lighting strip 1 of a lighting strip system a plurality of lights or light bodies 5 are present it is advantageous, for the purpose of avoiding an overloading, to provide a plurality of phase conductors in the through-wiring 11, e.g. three phase conductors. In this case the wires 12*a*, 12*c*, 12*e* and/or 12*f*, 12*h*, 12*j*, to which the lights are to be connected are provided in a distributed number. For this purpose there is associated with plug-in connection part 13*a* (not shown) or the plug-in connection part 13*b* a phase selection device 25 which in the case of the present configuration is formed by means of a displacement guide 26 for at least one contact element holder for a plug shaft 17, whereby the displacement guide 26 is displaceable advantageously at right angles to the lighting strip 1 selectively into the position of one phase conductor and is releasably arrestable in this displaced position. For this purpose the at least one plug shaft is formed as a slide 27 which is manually displaceable in the displacement device 26 on the body of the plug-in connection part 13*b*. The displacement guide is formed by a guide groove 28 (FIG. 4), in particular an undercut guide groove, extending transversely to the lighting strip 1 (FIG. 2), in which guide groove the at least one holder or plug shaft 17 is displaceably guided. The sliders 27 of the plug shafts 17 are adapted to the cross-sectional form of the guide groove 28 to permit this displacement. For arresting the side elements in their desired displacement positions, namely in the contact position with a desired phase conductor, there is provided in each case a clamping or latching device 29, which can be released. The latching devices have a latching recess 29*a* and a latching nose 29*b* which engages into the recess. In the present exemplary embodiment the latching device is arranged on the slider 27, or vice versa.

It should be noted that because FIG. 4 is a perspective view and because the plane of the strip 12 containing the various wires is above the plane of the connection part 13*b*, the positions of the wires a shown appear to be located forwardly of their actual positions.

As can be understood from FIGS. 2 and 3, the plug openings 14 in the plug-in connection parts 13*a* and the plugs or plug shafts 17 on the plug-in connection parts 13*b* are arranged in at least two rows R1, R2 for reasons of exploiting the space available. With a phase selection device it is thereby advantageous that in the rows R1 and R2 in each case two non-displaceable plug shafts 17 follow a displaceable plug shaft 17 which can be displaced over at least three neighboring wires 12. Such an arrangement can be realized in a simple manner, when plug-in connection parts are arranged next to one another, in that one plug-in connection part is arranged rotated by 180° with the regard to the other. This applies both for the plug-in connection parts 13*a*1, 13*a*2 and also for the plug-in connection parts 13*b*1, 13*b*2.

The above-described configuration of the lighting strip 1 improves on protection standard IP 65 so that the lighting strip 1 is dust-proof and protected against spray water. This protective standard is improved upon by means of the above-described configuration of the carrier rail 3 which, except for the plug recess 21 and the plug connection part 13*b* through the cover wall 3*c*, 3*c* is continuously closed, this closing being effected by the longitudinally continuous latching elements, namely the latching webs 3*d*, which bear throughout on the side walls 5*b*. In the abutment region of the carrier rail 3 and of the light body 5, the protective standard is ensured by means of seals 24.

The mounting of the lighting strip sections 2 can be made either at the place of manufacture or at the site of installation. The carrier rails 3, the light body 5 and the through-wiring 12 with the plug-in connection parts 13*a* are in each case pre-fabricated to this extent and made available as an intermediate product, for example on a roll. The through-wiring 11 can thereby in each case be adapted to the length L of the light strip section 2, if applicable with an excess in the joint region as necessary for the electrical connection; or it may form a long supply reserve. Significant is that the spacings of the plug-in connection parts 13*a* with slides 19 pre-fabricated on the through-wiring 11 correspond to the spacings of the recesses 21 from one another which correspond to the lengths L, but are axially offset with regard to the joints 1*a*.

The through-wiring 11, which is prefabricated with the one or more plug-in connection parts 13*b*, is mounted by introducing it longitudinally into the carrier rail 3 by pushing and/or pulling by means of a pulling cable or a pull or push rod or the like, and may be effected by means of an associated pushing or pulling device. The push rod or the pull cable can be longitudinally passed through the carrier rail 3, before pulling, and releasably connected with the associated end region of the wiring 12. Pulling in, the longitudinal wiring 11 is introduced so far into the carrier rail 3 that the plug-in connection part or parts 13*a*, or slide or slides 19. Thereby the longitudinal wiring 11 is introduced so far into the carrier rail that the plug-in connection part or parts 13*a*, or slide or slides 19, are located in the longitudinal position of the recesses 21. This position can be defined by means of a movement stop (not illustrated), which for example projects through the associated recess 21 into the path of movement of the slide 19. This fixing can be effected by means of stops placed into the recesses or for example frames which function as stops and which co-operate with counter-stops on the apposing plug-in connection part or slides. Thereby the thus formed arresting parts may also engage into holes in the plug-in connection parts or slides. Further, such an arresting can be effected by means of screws (not shown) penetrating through the cover wall 3*c* of the carrier rail 3 and engaging into the plug-in connection parts 13*a* or slides 19. In the transverse direction, the plug-in connection part 13*a* is positioned in the carrier rail 3 by means of their walls, which form a transverse positioning device 31. After the introduction, the longitudinal positioning can be effected by means of the available plug-in connection part or parts 13*b*, which by means of the form-fitting engagement into the associated plug-in connection part 13*a* form a longitudinal positioning device 32. A transverse positioning device for the slide 19 is, as described above, already provided by the internal dimensions of the carrier rail 3.

A dismounting of the through-wiring 11 with the plug-in connection part or parts 13*a* is effected in a reverse manner by means of longitudinally directed pulling out from the carrier rail 3, which can be effected manually or with the pull cable or push rod by means of an associated pulling device.

It is advantageous to so form the plug-in contact parts with a selection device 25 such that if necessary a coincidence can be brought about. With the present configuration, with which the contact positions are arranged in two rows R1, R2, the selection device 25 may be provided in the one or in the other row R1, R2 or in both rows R1, R2.

Figure 5:
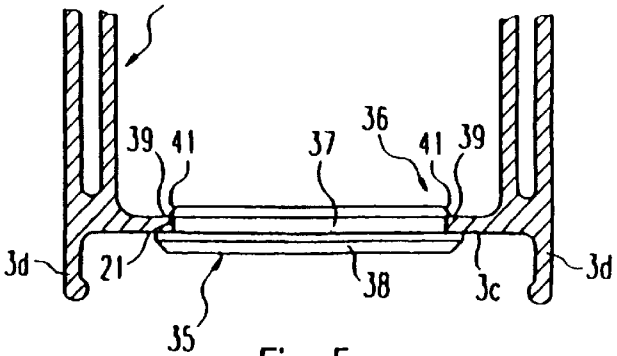
FIG. 5 is a fragmentary section view taken along line V—V of FIG. 2.

In each of the above-described exemplary embodiments, it is advantageous, for the covering or sealing of the hollow space in the carrier rail 3, to cover over or to seal with a closure part those recesses 21 which are not occupied with a plug-in connection part 13*b*, 13*b*1, 13*b*2. For this purpose there can be provided in each case a closure plate 35, for example in the configuration and arrangement in accordance with FIG. 5, which covers or seals the associated recess 21. With the exemplary embodiment according to FIG. 5, the closure plate 35 is releasably connected to the cover wall 3*c*, preferably by means of a latching device 36. The closure plate 35 may have an insertion part 37 on one broad side which is insertable into the recess 21. The insertion part 37 may, on one broad side thereof, have latching clamps or may otherwise be latchable therein with the latching device 36. Thereby, the closure plate 35 may have a flange 38 which engages over the outer recess edge of the recess 21. This not only secures the position of the closure plate 35 but it can also act in a covering and sealing manner. The latching device 36 may have a plurality of latching noses arranged distributed around its periphery, or it may have a continuous latching edge 39, which, in each case engage behind the inner edge of the recess 21. This engagement behind need only be slight. The material of the closure plate 35, at least in the region of the latching edge 39 is such that, the closure plate 35 can be pressed and latched into the recess 21 by means of rounded or chamfered introduction surfaces 41, and can drawn out of the recess 21 by means of a pressing out, for example with the aid of a screw driver engaging beneath the flange 38, with a slight application of force. The closure plate 35 is preferably of plastics having an elasticity as described above.

What is claimed is:

1. Lighting strip system comprising:

a carrier rail which bounds a hollow space, said carrier rail being mountable on a wall or ceiling, a plurality of electrical wires running longitudinally in said hollow space;

a plurality of coupling parts arranged in the hollow space and spaced apart from each other in a longitudinal direction of said carrier rail, said coupling parts being electrically connected with said electrical wires;

a plurality of elongate lights mounted one after another in said longitudinal direction on said carrier rail;

said carrier rail being formed with a wall, said wall being formed with recesses;

electrical counter-coupling parts on said lights, said counter-coupling parts extending through the recesses and into the hollow space where they make electrical plug contact with corresponding ones of said coupling parts;

said coupling parts each being slidable longitudinally within said carrier rail;

said coupling parts and said wires forming a prefabricated intermediate product; and said carrier rail having internal dimensions which permit close longitudinal guidance for longitudinal movement therein of said coupling parts.

2. Lighting strip system according to claim 1, wherein:

at least one of said coupling parts and counter-coupling parts comprises two coupling members arranged transversely next to one another for longitudinal movement on a common slide within said hollow space.

3. Lighting strip system according to claim 2, wherein:

said wires extend next to each other in a common plane and wherein one coupling part is rotated by 180° relative to a corresponding counter-coupling part, said coupling and counter-coupling parts extending parallel to said common plane.

4. Lighting strip system according to claim 1, further including:

a transverse positioning device configured to position said coupling parts transversely relative to the carrier rail.

5. Lighting strip system according to claim 1, further including:

a stop arranged to limit movement of coupling part into disposition with a corresponding counter-coupling part.

6. Lighting strip system according to claim 1, wherein:

the coupling parts are configured to be fixed on the carrier rail.

7. Lighting strip system according to claim 1, further including:

a frame mounted over at least one of said recesses in said carrier rail and an arresting means located on said frame for arresting movement of an associated coupling part.

8. Lighting strip system according to claim 1, wherein:

a light body having a U-shaped or a tube-like cross-sectional form is provided for each of said lights.

9. Lighting strip system according to claim 1, wherein a releasable connector is provided for connecting said lights with said carrier rail.

10. Lighting strip system according to claim 1, further including:

a contact position selector device is arranged in association with the coupling parts or said counter-coupling parts.

11. Lighting strip system according to claim 1, wherein:

said coupling parts and said counter-coupling parts have contact elements in two transversely running rows, and wherein said selection device is associated with at least one of said rows.

12. Lighting strip system according to claim 1, wherein:

recesses which are not occupied by counter-coupling parts or occupied recesses are closed by means of a closure element.

13. Lighting strip system according to claim 1, wherein:

at least one slide, which forms part of said prefabricated intermediate product, is provided in said hollow space in said carrier rail, said slide having cross-sectional dimensions that are so adapted to the associated internal dimensions of the carrier rail that the slide is longitudinally displaceable in the carrier rail with a slight play for movement whereby said carrier rail forms a longitudinal guide for the slide, and wherein;

said coupling part is mounted in said slide.

14. Lighting strip system according to claim 13, wherein:

said wires extend next to each other in a common plane and wherein one coupling part is rotated by 180° relative to a corresponding counter-coupling part, said coupling and counter-coupling parts extending parallel to said common plane.

15. Lighting strip system according to claim 13, further including:

a transverse positioning device configured to position said coupling parts transversely relative to the carrier rail.

16. Lighting strip system according to claim 13, further including:

a stop arranged to limit movement of coupling part into disposition with a corresponding counter-coupling part.

17. Lighting strip system according to claim 13, wherein:

the coupling parts are configured to be fixed on the carrier rail.

18. Lighting strip system according to claim 13, further including:

a frame mounted over at least one of said recesses in said carrier rail and an arresting means located on said frame for arresting movement of an associated coupling part.

19. Lighting strip system according to claim 13, wherein:

a light body having a U-shaped or a tube-like cross-sectional form is provided for each of said lights.

20. Lighting strip system according to claim 13, wherein a releasable connector is provided for connecting said lights with said carrier rail.

21. Lighting strip system according to claim 13, further including:

a contact position selector device is arranged in association with the coupling parts or said counter-coupling parts.

22. Lighting strip system according to claim 13, wherein:

said coupling parts and said counter-coupling parts have contact elements in two transversely running rows, and wherein said selection device is associated with at least one of said rows.

23. Lighting strip system according to claim 13, wherein:

recesses which are not occupied by counter-coupling parts or occupied recesses are closed by means of a closure element.

* * * * *